United States Patent [19]

Muellejans et al.

[11] 4,407,358

[45] Oct. 4, 1983

[54] LIGHT-WEIGHT CROSS-FLOW HEAT EXCHANGER UNIT

[75] Inventors: Herbert Muellejans, Stuttgart; Hans-Joachim Koetz, Nuertingen, both of Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 287,071

[22] Filed: Jul. 27, 1981

Related U.S. Application Data

[63] Continuation of Ser. No. 33,075, Apr. 25, 1979, abandoned.

[30] Foreign Application Priority Data

Apr. 25, 1978 [DE] Fed. Rep. of Germany ..... 2817990

[51] Int. Cl.[3] ..... F28F 3/10

[52] U.S. Cl. ..... 165/166; 29/157.3 R; 29/527.2; 165/180

[58] Field of Search ..... 165/157.3 D, 166, 157; 29/157.3 D, 157.4, 527.2

[56] References Cited

U.S. PATENT DOCUMENTS

| | | | |
|---|---|---|---|
| 2,795,035 | 6/1957 | Kafer | 165/171 |
| 2,985,434 | 5/1961 | Boring et al. | 165/166 |
| 3,640,340 | 2/1972 | Leonard | 165/166 |
| 3,734,177 | 5/1973 | Bellovary et al. | 165/166 |
| 4,053,969 | 10/1977 | Bayard | 29/157.3 D |

*Primary Examiner*—William R. Cline
*Assistant Examiner*—Theophil W. Streule
*Attorney, Agent, or Firm*—Schwartz, Jeffery, Schwaab, Mack, Blumenthal & Koch

[57] ABSTRACT

A cross-flow heat exchanger unit comprising a plurality of corrugated film elements stacked in alternating layers such that the ridges and grooves of each film element extend transversely to those of an adjacent film element. Flat divider elements are interposed between each pair of adjacent film elements, and the structure is enclosed by a coating which bonds the elements together to form a rigid heat exchanger block. The film elements may be of non-metallic material, and the coating may be a curable, synthetic resinous material.

7 Claims, 2 Drawing Figures

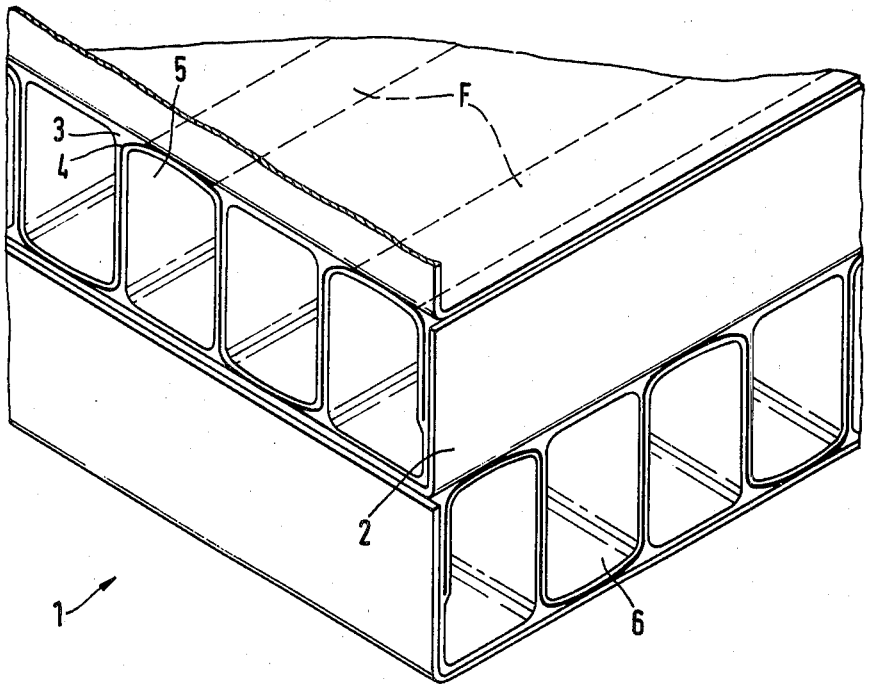
FIG. 1
FIG. 2
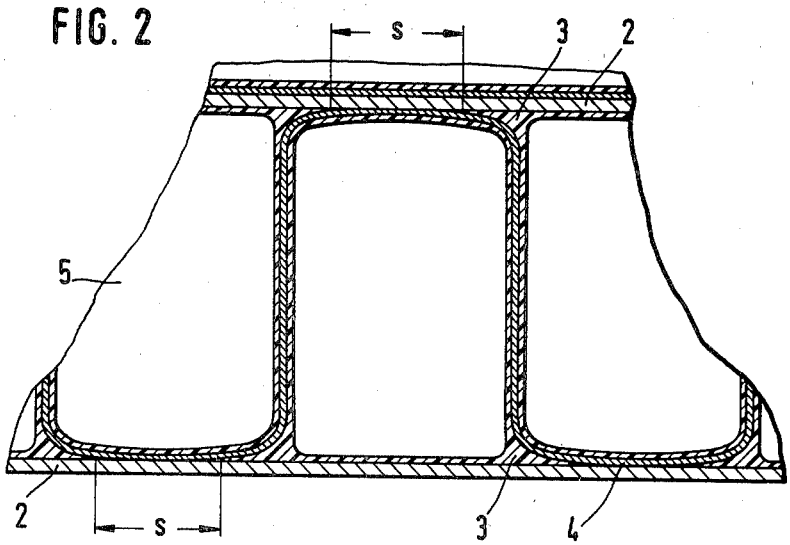

LIGHT-WEIGHT CROSS-FLOW HEAT EXCHANGER UNIT

This is a continuation of application Ser. No. 33,075, filed Apr. 25, 1979, now abandoned.

BACKGROUND OF THE INVENTION

1. Field of the Invention

The invention concerns a cross flow heat exchanger unit comprising corrugated film elements stacked transversely to one another. Flow channels leading in alternating directions are thus formed, through which primary and secondary streams of cooling gas, respectively, are passed.

2. The Prior Art

Heat exchanger unis generally of this type are known, for example, from Swiss CH-PS 588 672; although the foils arranged in stacks in alternating crosswise layers reduce the weight of the heat exchanger unit, the arrangement does not provide channels favoring the flow of the medium, because of partially transverse creases. Further, as the result of the small increase in the surface area provided by the creases, the installed heat exchanger surface area is relatively low. The contact surfaces of the creases have no metallic connection with the adjacent film layers, but are separated from them by an air gap and heat conduction between the films is thus interrupted. Finally, the design lacks mechanical stability insofar as the individual film layers are interconnected only at their edges by means of folded seams, and not at their inner areas. This leads to the danger of outward buckling in the presence of certain differences in pressure between the flowing media and the environment. On the other hand, the establishment of soldered joints, customarily employed in heat exchangers made of heavier sheet metal, is either not feasible with thin films or only at a commensurably higher cost.

SUMMARY OF THE INVENTION

It is the object of the invention to provide a heat exchanger unit using thin to very thin films of any material, the heat exchanger unit having the lowest possible weight and the smallest possible enclosed space, at a low manufacturing cost relative to the amount of heat exchanged between the heat-releasing and heat-absorbing gaseous media. It is further an object of the invention to provide such a heat exchanger unit having adequate structural stability.

The object is attained in accordance with the invention by forming the film elements with corrugations, by interposing a plurality of flat divider elements between stacked film elements, and by uniting the film elements and the divider elements into a mechanically rigid structure by enclosing the assembled elements with a coating material. The coating advantageously may comprise a commercially-available synthetic resinous material, such as an epoxy resin, and may be applied, for example, by means of immersion coating, flow coating or powder coating, and subsequently hardened into a durable elastic layer. This mode of construction, because of the use of corrugations, results in a highly-effective heat-exchanging surface when combined with divider elements.

The principal advantage of the heat exchanger unit according to the invention, however, will be found in its extremely low production costs, because expensive soldered or conventional adhesively bonded joints are eliminated and because the necessary mechanical connection between the corrugated film elements and the divider elements is attained by means of a simple coating process. This provides, at the same time, corrosion protection for the heat exchanger surfaces in contact with the media.

A further advantage may be found in the fact that contact surfaces are formed between the corrugated film elements and the divider elements to establish a thermally conducting bond. It is of particular advantage relative to the conduction of heat that no air gap appears between the corrugated film elements and the divider elements in the area of their mutually-contacting surfaces; there exists either direct contact between the corrugated film elements and the divider elements or an indirect contact in which a thin layer of the coating material is present in the area of the contacting surface. However, this additional separating layer only negligibly reduces the transfer of heat between the gaseous media involved.

According to a further advantageous embodiment of the invention it is posible to construct the heat exchanger of non metallic materials, that is, of lightweight, relatively inexpensive, synthetic materials. The poorer thermal conductivity of these materials affects the exchange of heat only to a small degree, because the exchange of heat takes place between gaseous media. The use of such inexpensive materials permits the manufacture of throwaway heat exchanger units of this type.

A preferred embodiment of the invention is shown in the drawing and is described in detail below.

DETAILED DESCRIPTION OF THE DRAWING

FIG. 1 shows a partial perspective view of the heat exchanger unit according to the invention; and FIG. 2 shows, in elevational view, an enlarged portion of the heat exchanger unit shown at X in FIG. 1.

THE PREFERRED EMBODIMENT

FIG. 1 shows a partial perspective view of a cross-flow heat exchanger unit 1, in which only two stacked layers of the corrugated film elements 4 with interposed divider elements 2 are represented. The complete heat-exchanger block 1 may comprise any number of layers stacked upon each other in the manner shown. As shown in FIG. 2, meander-shaped, corrugated film elements 4 are separated from one another by flat divider elements 2, so that primary flow channels 5 and secondary flow channels 6, leading in mutually transverse directions, are formed and that the heat releasing and the heat absorbing media are absolutely separated from each other. The corrugated film elements 4 and divider elements 2 are enclosed by a coating 3. The coating material may be, for example any curable synthetic resinous material suitable for the intended operating temperature range of the heat exchanger unit. The coating material may be applied, for example, by means of immersion of the entire block 1. After curing, the coating lends the structure formed by the stacked, corrugated film elements and interposed divider elements the necessary stability and may also provide corrosion protection against the flowing media. Following the application of the coating 3, areas "F" of width s remain between the divider elements 2 and the corrugated film elements 4, wherein no coating material has penetrated and where therefore a direct, gap-free contact is maintained between elements 2 and 4. In other words, the film and divider elements have surfaces, including contacting surfaces which touch each other (in the region F) and non-contacting surfaces which do not contact each other. It will be apparent from the foregoing discussion as to the coating material enclosing the heat exchanger elements and as to the coating material being applied, for example, by means of immersion of the entire block 1, and from the drawing, particularly FIG. 2 showing the coating 3, that the coating completely covers the non-contacting surfaces of the film elements to bond the film and divider elements together. This results in a thermally-conducting joint which conducts heat from the heat releasing medium to the heat absorbing medium without having to overcome an insulating air gap.

The heat-exchanger construction according to the invention permits the use of very thin metallic foils, as well as of non metallic materials, for example, synthetic films, because the mechanical bonding of the corrugated film elements to the divider elements provided by the coating layer confers upon the heat exchanger the stability of a sandwich-type structure.

The operating temperature range depends on the coating material applied to the structure. For example the coating material comprises metals pigments and is sold by the manufacturer Weckerle GmbH, D7000 Stuttgart 40 under the name WECO-Zinc-Staubfarbe WW 333-2000 respectively under the registered trade mark GRANALIT—this coating material is resistant to operating temperatures up to 500° Celsius. Another coating material for a lower operating temperature is sold by the same manufacturer under the name WEPICO-Zweikomponenten-Klarlack WW 538-0000—this coating material is appropriate to an operating temperature in the heat exchanger of about 200° Celsius.

We claim:

1. A cross-flow heat exchanger unit, comprising:

a plurality of stacked film elements, each said film element corrugated to form a series of alternating ridges and grooves, and said film elements arranged in alternating layers in which said ridges and grooves of each said film element extend substantially transversely to said ridges and grooves of an adjacent said film element;

a substantially flat divider element interposed between each pair of adjacent said film elements, said film and divider elements having contacting surfaces which tough each other and non-contacting surfaces which do not contact each other;

means for bonding together said stacked film elements and said interposed divider element or elements, said bonding means comprising a coating of curable, synthetic resinous material on the non-contacting surfaces of said film and divider elements, which coating completely covers the non-contacting surfaces of at least said film elements to bond said film and divider elements together;

whereby a mechanically rigid heat exchanger block is formed.

2. The cross-flow heat exchanger unit of claim 1, wherein said film elements are corrugated so as to have a meander-shaped cross-section, said film elements having surfaces in contact with said divider elements.

3. The cross-flow heat exchanger unit of claim 1 or 2, wherein said film elements and said divider element comprise a non-metallic material.

4. A cross-flow heat exchanger unit according to claim 1, wherein said film and divider elements are in direct contact with each other at said contacting surfaces.

5. The cross-flow heat exchanger unit as set forth in claim 1, wherein said coating of curable, synthetic resinous material is the only structure holding said thin film and divider elements together.

6. A heat exchanger unit having a plurality of corrugated or ribbed channels forming first elements and non-corrugated or non-ribbed partition-forming second elements, said first and second elements having contacting surfaces which touch each other and non-contacting surfaces which do not contact each other;

means for bonding together said first and second elements, said bonding means comprising a coating of curable, synthetic resinous material on the non-contacting surfaces of said first and second elements, which coating completely covers the non-contacting surfaces of at least said first elements to bond said first and second elements together;

whereby a mechanically rigid heat exchanger is held together by a coating on the external surfaces thereof.

7. A heat exchanger unit as set forth in claim 6, wherein said coating of curable, synthetic resinous material is the only structure holding said first and second elements together.

* * * * *